US005368410A

United States Patent [19]

Ferraiolo

[11] Patent Number: 5,368,410

[45] Date of Patent: Nov. 29, 1994

[54] PROCESS FOR MAKING A MATTRESS-TYPE GABION FOR SOIL STABILIZATION

[75] Inventor: Francesco Ferraiolo, Ca'de Fabbri, Italy

[73] Assignee: Officine Maccaferri SpA, Bologna, Italy

[21] Appl. No.: 12,538

[22] Filed: Feb. 2, 1993

[51] Int. Cl.[5] ..... E02B 3/12

[52] U.S. Cl. ..... 405/16; 405/15; 405/19

[58] Field of Search ..... 405/15, 16, 19, 21, 405/258

[56] References Cited

U.S. PATENT DOCUMENTS

| | | | |
|---|---|---|---|
| 841,281 | 1/1907 | Thorne | 405/19 |
| 4,394,924 | 7/1983 | Zaccheroni | 405/16 X |
| 4,483,640 | 11/1984 | Berger et al. | 405/15 |
| 4,655,637 | 4/1987 | Vignocchi | 405/15 X |
| 4,717,283 | 1/1988 | Bach | 405/258 X |
| 4,804,293 | 2/1989 | Varkonyi et al. | 405/15 |
| 5,076,735 | 12/1991 | Hilfiker | 405/258 X |

FOREIGN PATENT DOCUMENTS

| | | | |
|---|---|---|---|
| 354735 | 10/1905 | France | 405/19 |
| 52209 | 5/1981 | Japan | 405/16 |
| 204207 | 11/1983 | Japan | 405/16 |
| 123608 | 7/1985 | Japan | 405/15 |
| 146327 | 5/1992 | Japan | 405/15 |
| 93509 | 2/1960 | Netherlands | 405/15 |

*Primary Examiner*—Randolph A. Reese
*Assistant Examiner*—John A. Ricci
*Attorney, Agent, or Firm*—Herbert Dubno

[57] ABSTRACT

Mattress Gabions are provided for soil stabilization revetments, designed to halt erosion and/or to consolidate the soil. A protective revetment consisting of a structure of vegetable matter forms a mattress gabion which retains the soil inside each of a multiplicity of individual cells. Each cell of the container can be filled with earth or a soil or soil-forming mixture, encouraging the growth of vegetation inside the mattress, in order to afford a natural protection to the soil of banks or excarpments, etc. Once it has been filled, the mattress is closed by a top cover in double twist steel mesh, after laying a geosynthetic sheet between the two to keep in fine materials.

8 Claims, 2 Drawing Sheets

PROCESS FOR MAKING A MATTRESS-TYPE GABION FOR SOIL STABILIZATION

FIELD OF THE INVENTION

The present invention relates to a process for the creation of artificial soil protection and lining structures in the form of mattress-type gabions made of double twist wire netting which are filled with soil to create a protective vegetable revetment, i.e. for soil stabilization.

BACKGROUND OF THE INVENTION

It is known that revetments and other protective structures are employed to halt soil erosion caused by runoff or precipitation.

These structures are constructed using so-called mattress gabions, i.e., rectangular containers filled with gravel, crushed stone and other material, fitted with a cover and consisting of galvanized or galvanized and plastic-coated double twist wire netting panels joined together with ties or wire stitches. These structures are corrosion-inhibiting and resistant to mechanical stresses.

One particular, well-known system for the creation of the above mentioned structures consists in the construction and use of large, thin "mattress gabions" designed to cover, without any break, extensive tracts of land of the most disparate conformation, as if they were actual "mattresses".

Preparation in the manufacturing plants consists of applying the wire netting, the mattresses being divided into cells by means of vertical partition walls made with the netting of the bottom sheet.

Also known is a system which directly forms the transverse partitions, known as "ribs", obtaining them from the bottom sheet by transverse folds of the same height as those of the "mattress", with similar folds forming the long side walls and short end walls.

The connection together of the sides of each rib, obtained by bending the bottom sheet, with the cover sheet and with the side and end walls is accomplished using wire stitches, some of them fitted in the factory assembled structure and some placed during installation.

When the container is filled with soil to act as ballast, there arises the problem of keeping the earth inside the structure and preventing leaching and dispersion.

Attempts have been made to overcome this problem, albeit with relatively unsatisfactory results, by using sheets of a geotextile material extended under and around the gabion.

OBJECT OF THE INVENTION

The main object of this invention is to provide a method of making a system designed to hold the soil inside each individual cell in the mattress gabion after it has been filled with soil, in order to create a vegetable revetment to protect or consolidate the soil of the embankment to be treated.

It is another object of the invention to provide an improved method of stabilizing an earthwork whereby disadvantages of earlier systems are avoided.

Still another object is to provide an improved gabion for the purposes described.

SUMMARY OF THE INVENTION

These objects are attained in accordance with the invention by lining the cells of the mattress with a geotextile material prior to being filled with soil to hold the soil in the cells and protect against leaching while allowing vegetative growth in the cells. The result is the formation of a layer measuring approximately 15–30 cm, which is reinforced (by the wire netting of the mattress) and also protective and stable, to enable the growth of vegetation inside the mattress gabion in order to afford natural protection to the bank, escarpment, etc. of soil.

Geotextile material must completely line the inside of the cells of the mattress, covering the bottom, walls, ends and partitions over the entire length of the inside retaining surfaces of the mattress itself.

When the mattress is installed on the ground prior to being filled, the geosynthetic lining is fastened with wire stitches (manually or automatically) to the inside frame of the galvanized or galvanized and plastic-coated double twist wire netting which comprises the mattress gabion.

The material of the wire stitches will have the same characteristics as the wire netting of the mattress.

Also required is an element or layer to retain fine material after the installed mattress has been filled with earth, to prevent leaching of the soil before the vegetation grows.

Designed to answer this purpose is a geocompound or layer which covers the whole of the top surface of the mattress and which is secured with wire stitches to the top edges and partition walls of the cells. The geocompound is introduced first, beneath the double twist wire netting cover, and it is fastened with wire stitches to the edges above the mattress to close the top of the gabion.

In practical application, the invention is characterized by two alternatives: one entails forming the geotextile cover (inside lining) with panels fastened with wire stitches to the individual cells of the inside surface of the mattress, connected individually therefore to the hexagonal structure of the netting. The other takes the form of a continuous sheet (single panel) fixed beforehand to one end of the element during production with wire stitches, but in this case it follows the unbroken profile of the inside surface of the mattress gabion both on the bottom and the transverse "ribs" (partitions) and end walls of the gabion structure.

Particular care is taken with installation prior to filling to ensure that the geotextile material is resting on and adheres to the wire netting of the gabion without forming pockets that would impair the perfect functioning of the invention.

This invention achieves the purpose, as has been briefly described, of permitting the formation of a system of mattress gabions with an internal vegetable protective lining to hold in and collect the soil inside each single cell or box of the mattress, encouraging the growth of vegetation inside the gabion itself. The term geotextile is intended to refer to an environmentally noncontaminating decay resistant fabric.

The geotextile fabric of the panels is generally composed of woven or non-woven material fibers, obtained using the technology of thermoplastics such as polyethylene or other appropriate materials, in individual panels or continuous sheets to be connected with wire stitches to the inside of the wire netting of the gabion.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
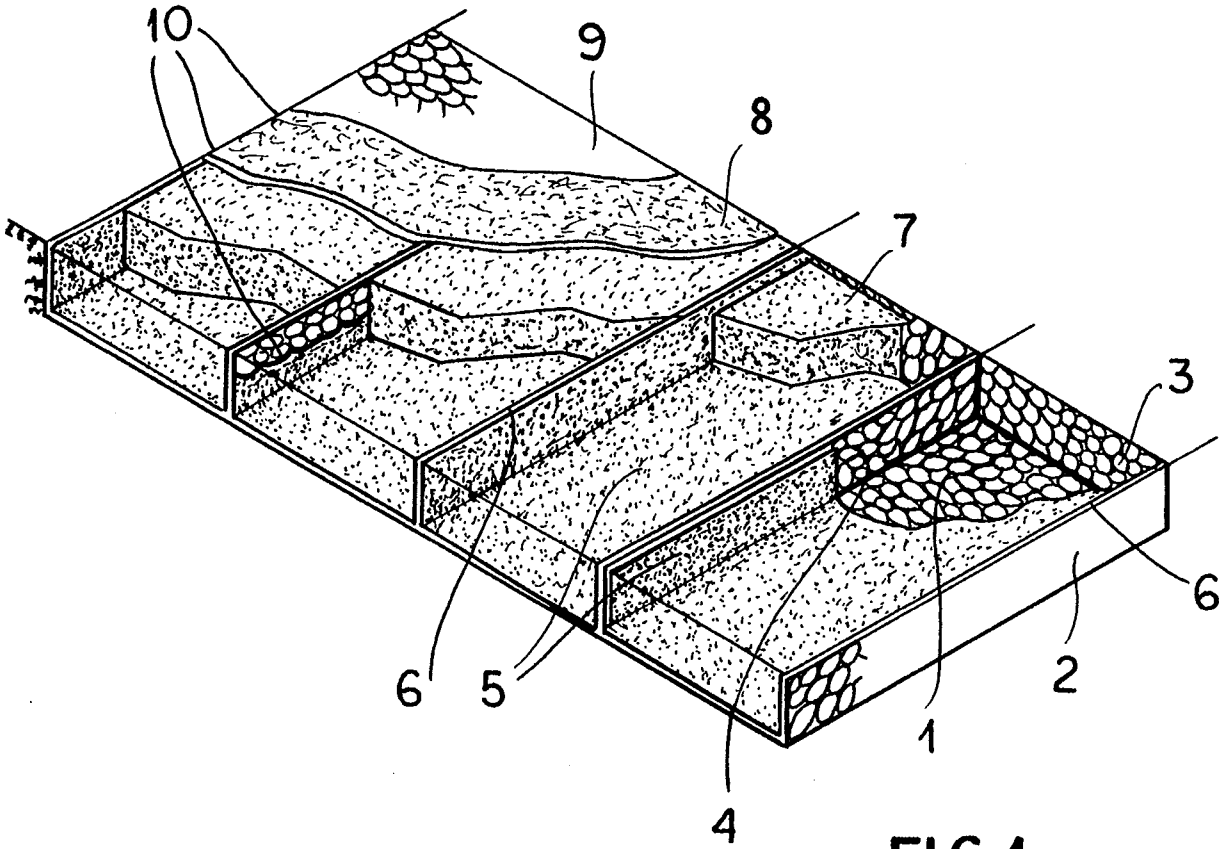
FIG. 1 is a diagrammatic perspective view, partly broken away, which shows a mattress gabion element with internal lining in the form of geotextile panels.

The mattress gabion element in FIG. 1 (in the drawing it is without the left side wall) is made by the standard factory assembly process except as noted below.

The galvanized or galvanized and plastic-coated hexagonal double twist wire netting, extending from the bottom sheet 1, with the end walls 2, the sides 3 and the partitions 4, is provided with a typical box-like structure of rectangular cells.

The galvanized and plastic-coated wire stitches 10, placed between the ribs and between these and the sides and also between the sides and the ends, give the structure stability.

On site, the structure is covered by the series of geotextile panels 5 which adhere perfectly to the wire netting, to which they are fastened with the wire stitches 6.

When all the cells in the mattress have been filled with soil 7, the mattress is covered first by a geocompound 8 to retain the fine materials and lastly by the wire netting cover 9 which will close the full mattress gabion when it is in place.

Similar wire stitches 10 fasten the sides of the ribs or partitions together, the geocompound to the sides of the gabion and the cover sheet to the sides.

Figure 2:
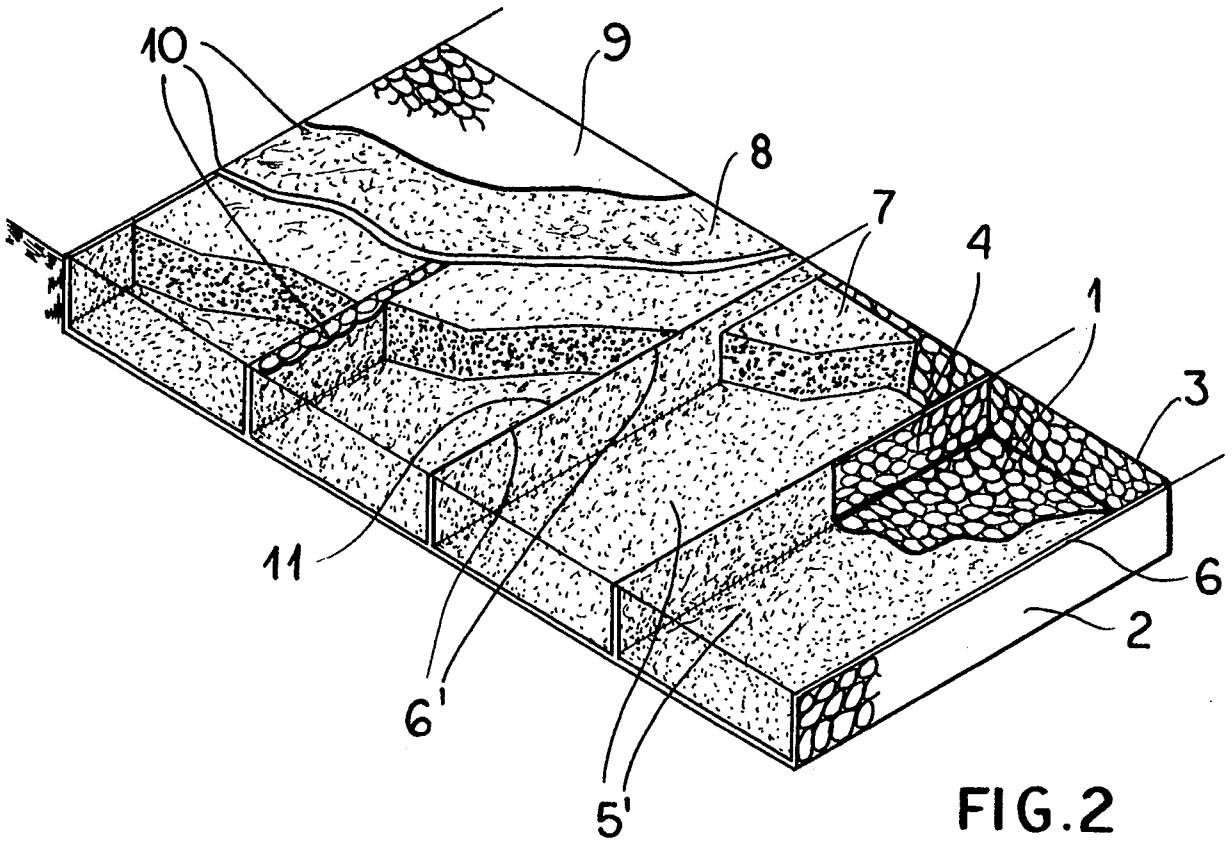
FIG. 2 is a similar view of a mattress gabion element with internal lining in the form of a continuous geotextile sheet, according to another embodiment of the invention.

In FIG. 2, the lining of the inside surfaces of the gabion is accomplished with a continuous sheet 5 of geotextile material, previously connected with wire stitches to one end of the mattress at the production stage. When installing the lining on site, the sheet, in addition to adhering to the surface, will also fold over and cover the ribs of the partitions 11, thereby covering the entire mattress without a break.

The wire stitching 6 of the continuous geotextile sheet will follow, maximum adherence to the inside surface being ensured to prevent the formation of voids.

The filling with earth 7, the laying of the geocompound 8 and the cover 9, and the wire stitching will follow as in the example of FIG. 1. The geocompound 8 can be a nonwoven fabric or mat of polyethylene filament or other material in sheet form, permeable to water and permitting growth of vegetation therethrough.

This invention, illustrated and described in schematic form and by way of example, may be extended to all those secondary variations regarding shape, size and material which, as such, all within its scope, while the technical details may be replaced by others of an equivalent technical nature, without stepping beyond the scope of protection afforded by the following claims.

What is claimed is:

1. A process for making a mattress gabion for stabilizing an earthwork, comprising the steps of:

(a) forming a wire mesh structure having a bottom and a plurality of upwardly open cells defined between partitions constituted by upstanding folds of wire mesh unitary with the bottom and subdividing said structure into said cells and longitudinal and transverse walls and wire stitching said partitions to said longitudinal walls;

(b) lining said partitions, said bottom and said walls internally of said cells with a geotextile material capable of retaining soil in said cells;

(c) filling said cells with a vegetation-growth supporting medium;

(d) applying a geotextile to said structure over said cells and said medium after said cells are filled with said medium;

(e) affixing said geotextile to said structure by wire stitching it to said partitions and said walls at upper edges thereof; and (f) affixing a cover of wire mesh over said structure after filling it with said medium.

2. The process defined in claim 1 wherein said geotextile material fully lines all of said bottom, said partitions and said walls, said process further comprising the step of stitching said geotextile material to said wire mesh structure at least at said walls and said partitions.

3. The process defined in claim 2 wherein said geotextile material is affixed to said partitions and said walls as separate panels.

4. The process defined in claim 2 wherein said geotextile material is affixed to said partitions and said walls as a single continuous sheet.

5. A method of stabilizing and earthwork, comprising the steps of:

forming a mattress gabion by:

shaping a wire mesh structure having a bottom and a plurality of upwardly open cells defined between partitions constituted by upstanding folds of wire mesh unitary with the bottom and subdividing said structure into said cells and longitudinal and transverse walls and wire stitching said partitions to said longitudinal walls, lining said partitions, said bottom and said walls internally of said cells with a geotextile material capable of retaining soil in said cells, filling said cells with a vegetation-growth supporting medium, affixing a cover of wire mesh over said structure after filling it with said medium, and applying a geocompound to said structure over said cells and said medium after said cells are filled with said medium and prior to the application of said cover thereto, and affixing said geocompound to said structure by wire stitching it to said partitions and said walls at upper edges thereof; and applying said mattress gabion to an earthwork to stabilize same.

6. A mattress gabion for stabilizing an earthwork, comprising:

a wire mesh structure having a bottom and a plurality of upwardly open cells defined between partitions constituted by upstanding folds of wire mesh unitary with the bottom and subdividing said structure into said cells, and longitudinal and transverse walls and wire stitching securing said partitions to said longitudinal walls;

a lining of a geotextile material interiorly of said cells along said partitions and said longitudinal and transverse walls for preventing escape of soil from said cells;

a filling of a vegetation-growth supporting medium in said cells;

a cover of wire mesh stitched with metal wire to said structure and covering said cells and;

a geocompound between said cover and said medium in said cells, said wire mesh structure and said cover being composed of hexagonal wire mesh.

7. The mattress gabion defined in claim 6 wherein said lining is a single continuous sheet extending over all of said bottom, said partitions and said walls.

8. The mattress gabion defined in claim 6 wherein said lining is formed as separate panels on said partitions, said bottom and said walls and stitched thereto.

* * * * *